United States Patent [19]

Barr

[11] Patent Number: 4,804,049

[45] Date of Patent: Feb. 14, 1989

[54] ROTARY DRILL BITS

[75] Inventor: John D. Barr, Cheltenham, England

[73] Assignee: NL Petroleum Products Limited, England

[21] Appl. No.: 676,710

[22] Filed: Nov. 30, 1984

[30] Foreign Application Priority Data

Dec. 3, 1983 [GB] United Kingdom ..... 8332342

[51] Int. Cl.[4] ..... E21B 10/46

[52] U.S. Cl. ..... 175/329; 175/410

[58] Field of Search ..... 175/329, 330, 410, 409; 406/146

[56] References Cited

U.S. PATENT DOCUMENTS

| | | | |
|---|---|---|---|
| 4,200,159 | 4/1980 | Peschel et al. | 175/329 |
| 4,382,477 | 5/1983 | Barr | 175/410 |
| 4,480,874 | 11/1984 | Shaw | 175/410 |
| 4,491,188 | 1/1985 | Grappendorf | 175/330 |

*Primary Examiner*—William P. Neuder

*Attorney, Agent, or Firm*—Browning, Bushman, Zamecki & Anderson

[57] ABSTRACT

The body of a rotary drill bit is formed from a matrix formed by a powder metallurgy process, and a plurality of cutting elements are mounted on the bit body, each cutting element being in the form of a disc of superhard material which is thermally stable at the temperature of formation of the matrix. The front surface of each cutting element is engaged by a holding structure on the bit body in front of the cutting element, the arrangement of the holding structure being such that the resistance provided by the holding structure to forward deflection of the portion of the cutting element opposite the cutting edge is less than the resistance to rearward deflection provided by the surface behind the cutting edge. Bending stresses imparted to the cutting element by rearward deflection thereof in the vicinity of the cutting edge are thereby reduced.

8 Claims, 2 Drawing Sheets

ROTARY DRILL BITS

BACKGROUND OF THE INVENTION

The invention relates to rotary drill bits for use in drilling or coring deep holes in subsurface formations.

In particular, the invention is applicable to rotary drill bits of the kind comprising a bit body having a shank and an inner channel for supplying drilling fluid to the face of the bit, and where the bit body carries a plurality of so-called "preform" cutting elements. Each cutting element is in the form of a tablet, usually circular, having a hard cutting face formed of polycrystalline diamond or other superhard material.

Conventionally, each cutting element is formed in two layers: a hard facing layer formed of polycrystalline diamond or other superhard material, and a backing layer formed of less hard material, such as cemented tungsten carbide. The two layer arrangement not only permits the use of a thin diamond layer, thus reducing cost, but also provides a degree of self-sharpening since, in use, the less hard backing layer wears away more easily than the harder cutting layer.

In one commonly used method of making rotary drill bits of the above-mentioned type, the bit body is formed by a powder metallurgy process. In this process a hollow mould is first formed, for example from graphite, in the configuration of the bit body or a part thereof. The mould is packed with powdered material, such as tungsten carbid, which is then infiltrated with a metal alloy, such as a copper alloy, in a furnace so as to form a hard matrix.

Where such a method is used to make a drill bit using natural diamond cutting elements; the diamonds are conventionally located on the interior surface of the mould before it is packed with tungsten carbide, so that the diamonds become embedded in the matrix during the formation of the bit body. The maximum furnace temperature required to form the matrix may be of the order of 1050°-1170° C, and natural diamonds can withstand such temperatures. Conventional preforms, however, are only thermally stable up to a temperature of 700°-750° C. For this reason preform cutting elements are normally mounted on the bit body after it has been moulded, and the interior surface of the mould is suitably shaped to provide surfaces to which the cutting elements may be subsequently hard soldered or brazed, or to provide sockets to receive studs or carriers to which the cutting elements are bonded.

This subsequent mounting of the cutting elements on the body is a time-consuming, difficult and costly process due to the nature of the materials involved, and, due to these difficulties, the mounting of some elements on the bit body is sometimes inadequate, giving rise to rapid fracture or detachment of the elements from the drill bit when in use. Furthermore, the mounting methods which have been developed, although generally effective, sometimes for reasons of space, impose limitations on the positioning of the cutting elements on the bit body.

There are, however, now available polycrystalline diamond materials which are thermally stable up to the infiltration temperature, typically about 1100° C. Such a thermally stable diamond material is supplied by the General Electric Company under the trade name "GEOSET".

This material has been applied to rotary drill bits by setting pieces of the material in the surface of a bit body so as to project partly from the surface, using a similar method to that used for natural diamonds. The pieces have been, for example, in the form of a thick element of triangular shape, one apex of the triangle projecting from the surface of the drill bit and the general plane of the triangle extending either radially or tangentially. However, since such thermally stable elements do not have a backing layer to provide support, they are of substantially greater thickness, in the cutting direction, than conventional preforms in order to provide the necessary strength. This may significantly increase the cost of the cutting elements. Furthermore, the increase in thickness means that the cutting elements are no longer self-sharpening since the portion of the element behind the cutting face does not wear away faster than the cutting face itself, as is the case, as previously mentioned, with two-layer cutting elements.

It is therefore an object of the present invention to provide a rotary drill bit using thermally stable cutting elements, in which the above-mentioned disadvantages of such elements may be overcome. The invention also provides a method of making a rotary drill bit using thermally stable cutting elements.

SUMMARY OF THE INVENTION

According to the invention there is provided a rotary drill bit including a bit body, at least a portion of which is formed from a matrix formed by a powder metallurgy process, and a plurality of cutting elements mounted on the bit body, each cutting element being formed from material which is thermally stable at the temperature of formation of the matrix, and having a rearward surface in engagement with a support structure on the bit body and a front surface, a portion of which provides a cutting edge projecting from the bit body, which front surface is engaged by a holding structure on the bit body in front of the cutting element, the arrangement of the holding structure being such that the resistance provided by the holding structure to forward deflection of the portion of the cutting element opposite the cutting edge is less than the resistance to rearward deflection provided by said support structure adjacent the cutting edge, thereby to reduce bending stresses imparted to the cutting element by rearward deflection thereof in the vicinity of the cutting edge.

Since bending stresses imparted to the cutting element are reduced, the thickness of each cutting element may be correspondingly reduced without increasing the risk of fracture of the elements during drilling. Not only does this reduce the cost of each cutting element, but the reduction in thickness of the cutting elements also provides a degree of self-sharpening since the material to the rear of each cutting element will wear away more rapidly than the material of the cutting element itself.

Various forms of holding structure may be provided to achieve the required lower resistance to forward deflection of the cutting element. For example the holding structure may comprise an integral extension of the matrix forming the bit body and extending partly over the front surface of the cutting element, the lower resistance to deflection being provided by the corss-section shape of the extension. The extension may be formed with an aperture or recess adjacent the portion of the front face of the cutting element, opposite its cutting edge. The resistance to deflection in this area may be further reduced by providing an aperture or recess in the matrix adjacent the portion of the rearward face of the cutting element opposite its cutting edge.

Alternatively, the lower resistance to deflection may be provided by the integral extension of the matrix being formed from matrix of a lower modulus of elasticity than the material providing said support structure for the cutting element.

In a further alternative arrangement, the holding structure may comprise a separate preformed element part of which is held in the matrix of the bit body and part of which projects from the bit body and extends partly across and in contact with the front surface of the cutting element. In this case the lower resistance to deflection provided by the holding element may be provided by forming the holding element from suitably resilient material and/or by suitable shaping the holding element. For example the holding element may be provided with an aperture or recess adjacent the portion of the front face of the cutting element opposite its cutting edge.

In any of the arrangements described above the support structure which is adjacent the rearward surface of the cutting element may be provided by an insert in the bit body, the modulus of elasticity of the insert being higher than the modulus of elasticity of the matrix making up the rest of the bit body.

Since the cutting elements of a bit body according to the invention are thermally stable, such a bit body may be manufactured by a method which incorporates the elements in the bit body during the formation of the bit body, rather than mounting the elements on the bit body after it has been formed, as has been the case hitherto with preform cutting elements.

Accordingly, the invention also provides a method of manufacturing by a powder metallurgy process a rotary drill bit including a bit body having a plurality of cutting elements mounted on the outer surface thereof, the method being of the kind comprising of the steps of forming a hollow mould for moulding at least a portion of the bit body, packing the mould with powdered matrix material, and infiltrating the material with a metal alloy in a furnace to form a matrix, the method further comprising the steps, before packing the mould with powdered matrix material, of:

a. positioning in spaced locations on the interior surface of the mould a plurality of cutting elements, each of which is formed of a material which is thermally stable at the temperature necessary to form the matrix, and b. providing adjacent the front side of each cutting element means which, upon packing of the mould and formation of the matrix, provide at least a portion of a holding structure to hold the element in position on the bit body, the holding structure being such that the resistance provided by the holding structure to forward deflection of the portion of the cutting element opposite the cutting edge is less than the resistance to rearward deflection provided by material supporting the rearward surface of the cutting element adjacent the cutting edge thereof, thereby to reduce bending stresses imparted to the cutting element by rearward deflection thereof in the vicinity of the cutting edge.

The means for providing said holding structure may comprise a recess in the surface of the mould extending across part of the frontward surface of each cutting element, when said element is in position in the mould, which recess receives powdered matrix material when the mould is packed and thereby, when the matrix is formed, provides a holding portion integral with the matrix body and engaging the front face of the cutting element to hold it in position on the bit body, the lower resistance to deflection of the holding portion in the finished bit body being provided by the configuration of the holding portion as defined by said recess in the mould.

The material to fill said recess in the mould to form an integral extension of the matrix to act as a holding structure may be applied to the mould in the form of a material, such as a powdered matrix material, which is converted to a hard material of lower modulus of elasticity than the rest of the matrix as a result of the process for forming the matrix. For example, the powdered matrix material from which the matrix is formed may be applied to the mould as a compound, known as "wet mix", comprising the powdered material mixed with a liquid to form a paste. The liquid may be a hydrocarbon such as polyethylene glycol. Accordingly, the material for application to the recess to form the holding structure may be applied in the form of a body of "wet mix" applied to the recess adjacent the front side of the cutting element before the rest of the mould is packed, the characteristics of the initial body of "wet mix" being such that the resulting matrix has a lower modulus of elasticity than the matrix forming the rest of the bit body. The characteristics of the wet mix may be varied, for example by varying the powder grain size distribution to vary the skeletal density and thus adjust the hardness of the resulting matrix.

Other methods of varying the hardness of the matrix in the wet mix may be employed, for example the addition to the wet mix of a powder, such as tungsten metal, nickel or iron powder, which will result in a matrix of lower modulus of elasticity. Instead of, or in addition to, reducing the hardness of the holding structure, the hardness of the support structure adjacent the rearward surface of each cutting element may be increased, for example by using at that location a body of wet mix of suitable characteristics. Thus, the normal matrix from which the bit body is formed may include nickel, and the hardness of the bit body adjacent the rearward side of each cutting element may be increased by placing at that location, in the mould, a body of wet mix in which the proportion of nickel is reduced.

Alternatively, the means providing the holding structure may comprise a separate preformed element which is initially located in the mould in engagement with the front side of the cutting element in such manner than, after packing of the mould and formation of the matrix, the element is held by the matrix and, in turn, holds the cutting element in position on the bit body.

The preformed holding element may be an elongate element on end of which is held in the finished bit body and the opposite end of which extends partly across and in contact with the front surface of the cutting element.

In the case where the holding structure comprises a separate preformed element, the lower resistance to deflection provided by the holding element may be provided by an aperture or recess in the element adjacent the portion of the front face of the cutting element opposite its cutting edge.

In any of the above arrangements each cutting element may be formed of polycrystalline diamond material and may be in the form of a tablet, such as a circular disc, of such material, the opposite major faces of the tablet constituting said front and rearward faces thereof respectively.

DETAILED DESCRIPTION OF PREFERRED EMBODIMENTS

Figure 1:
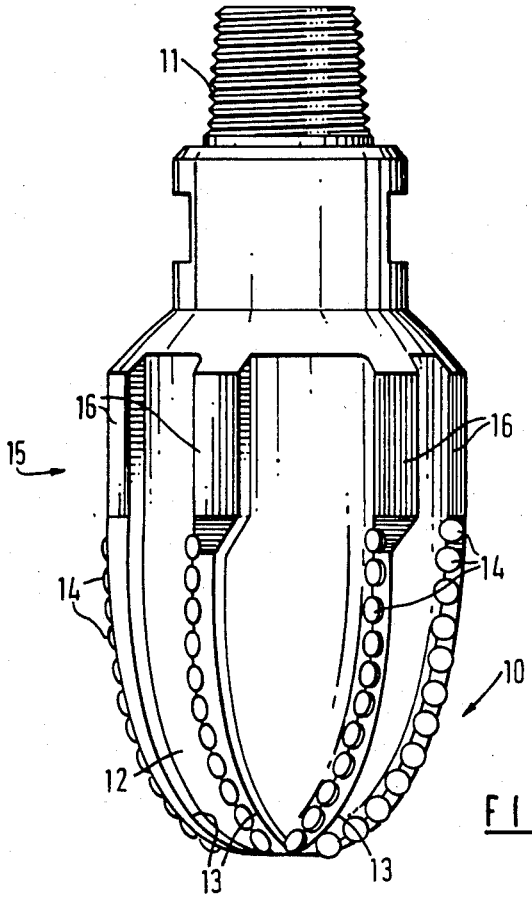
FIG. 1 is a side elevation of a typical drill bit of a kind to which the invention is particularly applicable.
Figure 2:
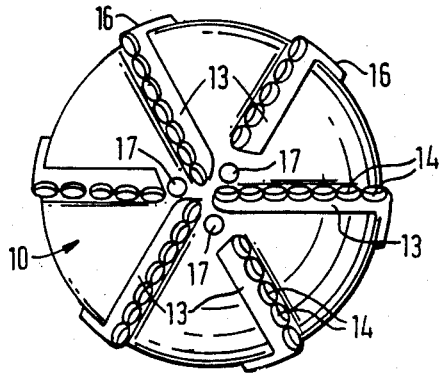
FIG. 2 is an end elevation of the drill bit shown in FIG. 1.

Referring to FIGS. 1 and 2, the rotary drill bit comprises a bit body 10 which is typically formed of tungsten carbide matrix infiltrated with a binder alloy, usually a copper alloy. There is provided a steel threaded shank 11 at one end of the bit body for connection to the drill string.

The operative end face 12 of the bit body is formed with a number of blades 13 radiating from the central area of the bit and the blades carry cutting elements 14 spaced apart along the length thereof.

The bit has a gauge section 15 including kickers 16 which contact the walls of the borehole to stabilise the bit in the borehole. A central channel (not shown) in the bit body and shank delivers drilling fluid through nozzles 17 in the end face 12 in known manner.

It will be appreciated that this is only one example of the many possible variations of the type of bit to which the invention is applicable.

The techniques of forming such bit bodies by powder metallurgy moulding processes are well known, as previously mentioned, and there will now be described modifications of the known methods by which thermally stable cutting elements are mounted on the bit body in the course of the moulding process, instead of the cutting elements being mounted on the bit body after moulding, as has previously been the case with preforms.

Figure 3:
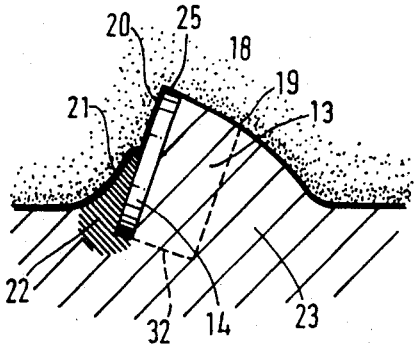
FIG. 3 is a diagrammatic section through a cutting element of a rotary drill bit illustrating the construction and method of manufacture according to the invention.

Referring to FIG. 3, a mould 18 is formed from graphite and has an internal configuration corresponding generally to the required surface shape of the bit body or a portion thereof. This is to say the mould 18 is formed with elongate recesses 19 corresponding to the blades 17. Spaced apart along each recess 19 are a plurality of part-circular recesses 20 each corresponding to the required location of a cutting element. A further recess 21 is provided in the surface of the mould 18 adjacent each recess 20.

Following construction of the mould, a plurality of circular disc-shaped thermally stable cutting elements 14 are secured within the recesses 20, as shown in FIG. 3, by means of suitable adhesive.

As previously mentioned, the mould may be packed with powdered matrix material in the form of a compound, known as "wet mix", comprising tungsten carbide powder mixed with polyethylene glycol. Once the mould has been packed it is heated in a furnace to burn off the polyethylene glycol whereafter the material is infiltrated with copper alloy to form the matrix.

In accordance with the present invention, however, before the mould is packed with wet mix in the normal way, the recess 21 adjacent the front side of each cutting element 14 is partly filled with a body of wet mix, indicated at 22, the composition of which is such that the resulting matrix has a lower modulus of elasticity than the matrix 23 forming the main part of the bit body. The body of wet mix 22 extends around the radially inner edge of the cutting element 14, opposite its cutting edge 25.

The body of matrix formed in the recess 21 provides, in the finished body, a holding structure which holds the cutting element 14 to the bit body. The extremity of the holding structure will, in use, wear down at least as rapidly as the cutting element 14 and blade 19, as drilling proceeds, the erosion being due largely to the flow of drilling mud and debris over the holding portion. This ensures that an adequate area of the front cutting face of the cutting element 14 remains exposed as the cutting element becomes worn.

Loads imparted to the cutting element 14 during drilling put compressive stress on the matrix to the rear of the cutting element 14, particularly in the vicinity of the cutting edge 25. Yielding of this matrix material under such stress will impose bending stresses on the cutting element if the cutting element is rigidly held. However, according to the invention, the matrix 24 adjacent the front face of the cutting element in the vicinity thereof opposite the cutting edge 25 is of lower modulus of elasticity than the matrix forming the main part of the bit body so that it provides less resistance to deflection of the cutting element than does the matrix forming the bit body. Consequently the cutting element may in effect tilt bodily when under load rather than being subject to high bending stresses. There is thus less tendency for the cutting element to fracture and it may therefore be of lesser thickness than would otherwise be the case, not only reducing the cost of the cutting element, but also providing a degree of self-sharpening. Some compositions of "wet mix" may provide a matrix having both sufficiently low erosion resistance and sufficiently low modulus of elasticity. In this case the recess 21 may be filled with a single body of such wet mix instead of with two different compositions.

Figure 4:
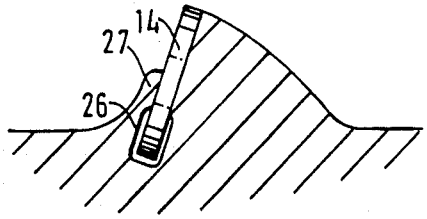
FIGS. 4 and 5 are similar views through alternative mountings of cutting elements according to the invention.

In the alternative arrangement shown in FIG. 4 the lower resistance to deflection of the cutting element 14 provided by the holding structure is provided by forming within the matrix an aperture 26 into which the edge of the cutting element projects so that the integral extension 27 of the matrix which forms the holding element engages only the central portion of the cutting element. The aperture 26 may be formed by initially enclosing the edge portion of the cutting element in a material which burns off as the matrix is formed. Preferably, the material may be retained in the finished bit body and in this case is a material of lower modulus of elasticity than the matrix. The integral extension 27 of the matrix may be of the same composition as the main body of matrix or may be formed from a different wet mix so as to be of lower modulus of elasticity.

Figure 5:
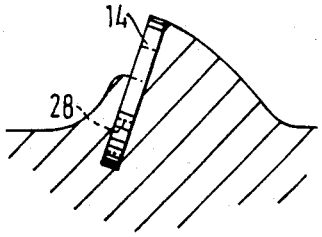
Figure 6:
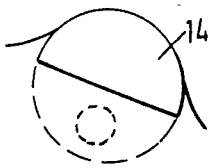
FIG. 6 is a front elevation of the cutting element shown in FIG. 5, and FIGS. 7 and 8 are similar views to FIGS. 3 to 5 of still further arrangements.

In the arrangements of FIGS. 5 and 6 the cutting element 14 is preformed with a hole 28 which fills with matrix and thus positively holds the cutting element to the bit body. A similar holding effect may be obtained by the element being formed with one or more recesses which fill with matrix.

Figure 7:
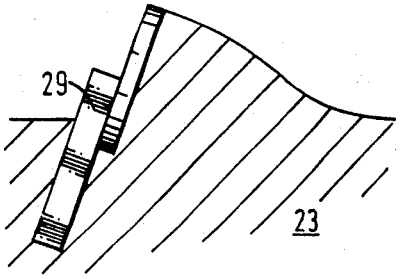

Instead of the holding structure on the front side of each cutting element comprising an integral extension of the matrix body, it may comprise a separately preformed holding element which is located in the mould adjacent and in contact with the front surface of the cutting element 14. For example, as shown in FIG. 7, the holding element may be in the form of an elongate bar 29 which is so located in the mould that, when the matrix has been formed, part of the bar 29 is embedded in the matrix body 23 and part of its projects from the matrix body and across the front face of the cutting element. In order to provide the required lower resistance to deflection of the portion of the cutting element engaged by the holding element 29, the holding element is formed from a suitable resilient material of low modulus of elasticity. For example, the bar may be formed from a nickel-chromium alloy.

In order to prevent too rapid erosion of the exposed part of the bar 29 in use, it may be necessary to provide the bar with a hard facing.

Figure 8:
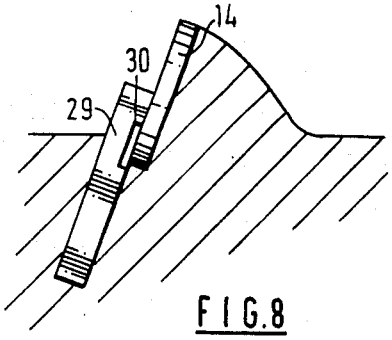

In the alternative arrangement shown in FIG. 8, the lower resistance to deflection is provided alternatively or in addition to the resilience of the element 29 by providing a recess 30 in the elongate holding element 29, so that the holding element engages only the central portion of the front surface of the cutting element 14.

In the arrangements of FIGS. 7 and 8, the preformed holding elements 29 are placed in the mould and become embedded in the bit body as the matrix is formed in the furnace. In an alternative method, the holding elements are replaced in the mould by forming elements which are removed from the bit body, after it has been formed, to leave holes in the body. Separate preformed holding elements, which may be similar to the elements 29 in FIGS. 7 and 8, are then secured in the holes in the bit body, for example by brazing. Such a method is suitable where the preformed holding elements are such that they cannot withstand the furnace temperature.

Although the cutting elements have been described above as being circular discs or tablets, other forms of cutting element are, of course, possible.

The purpose of the described holding arrangements for the cutting element 14 is, as previously mentioned, to reduce the risk of fracture of the cutting elements due to bending stresses imparted to them during drilling as a result of yielding of the material on the rearward side of the cutting elements. Although the risk of fracture is thus reduced by the arrangements described a further improvement may be obtained by inserting on the rearward side of each cutting element a support of a higher modulus of elasticity than the matrix and such a support is indicated in dotted lines at 32 in FIG. 3. The insert 32 may also be incorporated in the bit body in the course of the moulding process, and may comprise a rigid preformed insert or a body of wet mix of such composition to give a matrix of high modulus of elasticity.

Although the invention has been described in relation to single layer cutting elements of polycrystalline diamond, this is merely because this is the only type of thermally stable preform cutting element which is currently available. The present invention relates to methods of holding the preform in the bit body rather than to the particular material of the preform, and thus includes within its scope drill bits and methods of the kinds referred to when used with other types of thermally stable cutting elements which may be developed, including two-layer or multi-layer preforms and those where the superhard material is material other than polycrystalline diamond.

I claim:

1. A rotary drill bit including a bit body, at least a portion of which is formed from a matrix formed by a powder metallurgy process, and a plurality of cutting elements mounted on the bit body, each cutting element being formed from material which is thermally stable at the temperature of formation of the matrix, and having a rearward surface in engagement with a support structure on the bit body and a front face, a first portion of the cutting element providing a cutting edge projecting from the bit body, and the matrix forming the bit body being formed with an integral extension which engages and extends over the front surface of a second portion of the cutting element opposite the cutting edge, the thickness of the cutting element, between said front and rearward surfaces, being several times smaller than the dimension of said front face measured centrally thereacross in the direction between said cutting edge and said second portion, said extension and said support structure being adapted to offer less resistance to forward deflection of said second portion of the cutting element than to rearward deflection of the first portion, thereby to reduce bending stresses imparted to the cutting element, in use of the bit by rearward deflection thereof in the vicinity of the cutting edge.

2. A rotary drill bit according to claim 1, wherein said integral extension of the matrix which engages said second portion of the cutting element is thinner, in the forward and rearward direction, than the support structure on the bit body which is engaged by the rearward surface of the cutting element, thereby providing the lower resistance to deflection offered by said integral extension of the matrix.

3. A rotary drill bit according to claim 1, wherein the extension is formed with an aperture or recess adjacent the front surface of said second portion of the cutting element.

4. A rotary drill bit according to claim 1, wherein an aperture or recess is provided in the matrix adjacent the rearward surface of the second portion of the cutting element.

5. A rotary drill bit according to claim 1, wherein said integral extension of the matrix is formed from matrix of a lower modulus of elasticity than the material forming said support structure for the cutting element.

6. A rotary drill bit according to claim 1, wherein the support structure adjacent the rearward surface of the cutting element is provided by an insert in the bit body, the modulus of elasticity of the insert being higher than the modulus of elasticity of the matrix making up the rest of the bit body.

7. A rotary drill bit according to claim 1, wherin each cutting element is formed of polycrystalline diamond material and is in the form of a tablet of such material, the opposite major faces of the tablet constituting said front and rearward faces thereof respectively.

8. A rotary drill bit according to claim 7, wherein each cutting element is in the form of a circular disc.

* * * * *